US006158508A

United States Patent [19]

Lemetayer et al.

[11] Patent Number: 6,158,508

[45] Date of Patent: Dec. 12, 2000

[54] METHOD OF OPERATING A PLANT FOR THE PRODUCTION OF HYDROCARBONS

[75] Inventors: Pierre Lemetayer, Pau; Michel Casagrande, Serres Ste Marie, both of France

[73] Assignee: Elf Exploration Production, France

[21] Appl. No.: 09/275,271

[22] Filed: Mar. 23, 1999

[30] Foreign Application Priority Data

Mar. 24, 1998 [FR] France ..... 98 03613

[51] Int. Cl.[7] ..... E21B 43/12; E21B 44/00

[52] U.S. Cl. ..... 166/250.15; 166/52; 166/53; 166/369

[58] Field of Search ..... 166/250.15, 53, 166/52, 369

[56] References Cited

U.S. PATENT DOCUMENTS

| | | | |
|---|---|---|---|
| 2,845,125 | 7/1958 | Truman | 166/52 |
| 4,102,394 | 7/1978 | Botts | 166/66 |
| 4,305,463 | 12/1981 | Zakiewicz | 166/52 |
| 4,685,522 | 8/1987 | Dixon et al. | 166/372 |
| 4,967,843 | 11/1990 | Corteville et al. | 166/366 |
| 5,662,165 | 9/1997 | Tubel et al. | 166/250.01 |

FOREIGN PATENT DOCUMENTS 2 252 797 8/1992 United Kingdom .

OTHER PUBLICATIONS

Robin P. et al., "La Communication Homme–Processus Dan Les Sytemes Hierarchises de Commande de L'Industrie Petroliere" ("Communication Man—Process in Control Systems Hierarchically Organized in Petroleum Industry"). 8132—RGE: Revue Generale de I'Electricite (1988) Nov., No. 10, Paris, France.

*Primary Examiner*—Hoang Dang

*Attorney, Agent, or Firm*—Blank Rome Comisky & McCauley, LLP

[57] ABSTRACT

The invention relates to the production of hydrocarbons in the form of oil and gas, by means of a plant comprising several wells, a system for collecting the hydrocarbons produced and a downstream unit for treating the hydrocarbons produced, it being possible for this plant to additionally comprise a pressurized-gas system for activating the wells.

According to the invention, the systems and the downstream unit having sensors for measuring physical quantities representative of their operation, each well being controlled according to an individual procedure using modifiable control parameters and data representative of the operating status of the single controlled well, the control parameters used by the individual procedure for controlling each of the wells are automatically modified, depending on the value of at least one of the measured physical quantities and on the data representative of the operating status of all the wells.

The application of the invention is in the petroleum industry.

19 Claims, 2 Drawing Sheets

METHOD OF OPERATING A PLANT FOR THE PRODUCTION OF HYDROCARBONS

DESCRIPTION

1. Technical Field

The present invention relates to a method of operating a plant for the production of hydrocarbons in the form of oil and gas, comprising several wells, a pressurized-gas system for activating the wells, a system for collecting the hydrocarbons produced and a downstream unit for treating the hydrocarbons produced.

The application of the invention is in the extraction of hydrocarbon deposits on land or offshore.

2. State of the Prior Art

There are generally three modes of production from wells:

flowing mode, activated mode using gas injection, activated mode using a submerged pumping device.

Whatever their mode of production, all oil wells comprise a production string which connects the bottom of the well located near the hydrocarbon reservoir to a wellhead located at the top of the well.

The production string, together with the casing which forms the wall of the well, defines an annular space.

At the top of the well, the production string is connected to a line provided with a sensor for measuring the flow rate of the hydrocarbons produced and with an oil output choke which allows the flow rate of the hydrocarbons produced to be controlled.

A known procedure for operating such a well, producing in flowing mode, consists in slaving the flow rate of the hydrocarbons produced by this well to a set value or in slaving the position of the oil output choke to an opening setting.

A well producing in gas-injection-activated mode, using a pressurized-gas system, additionally includes an annular isolating seal at its lower end, gas-injection valves placed at optimized intervals along the production string and a gas-injection line in the annular space, this line being fitted with a choke for controlling the flow rate of injected gas.

The effect of the injected gas is to lighten the hydrocarbons which flow through the production string, hereby helping them to rise up towards the wellhead.

One procedure of operating a well producing in gas-injection-activated mode is described in document FR 2 672 936. This procedure consists in simultaneously acting on the oil output choke and on the choke for controlling the flow rate of injected gas, in order to control the flow rate of the hydrocarbons produced depending on the value of physical quantities measured by sensors, such as the pressure and temperature of the hydrocarbons upstream of the oil output choke, the pressure in the annular space or the flow rate of gas injected into the well.

A well producing in activated mode using a submerged pumping device includes, like the wells producing in the other two modes, a line provided with an oil outlet connected to the top of the production string, plus another line connected to the top of the annular space and provided with a gas ventilation choke. This choke makes it possible to control the flow rate of ventilation gas, i.e. to extract from the well the excess free gas under the thermodynamic conditions at the bottom of the well.

Such a well additionally includes, at the bottom, a submerged pump driven by an electric motor supplied by a variable-frequency supply, which allows the hydrocarbons at the bottom of the well to rise up towards the wellhead via the production string.

A procedure for operating a well producing in activated mode using a submerged pumping device is described in French Patent Application No. 98/01782 of 3.02.1998. This procedure consists, in order to control the flow rate of oil produced, in simultaneously acting on the oil output choke and gas ventilation choke and on the speed of the electric motor, depending on the pressures upstream of the two chokes, on the current drawn by the electric motor and on physical quantities indicative of the production from the well, such as the pressure at the bottom of the well, the temperature or the output flow rate of oil from the well.

Each of these control procedures acts depending on one or more physical quantities specific to the well being controlled. They do not take account of the operating status of the other wells, nor of the behaviour of the activation gas system common to all the gas-injection-activated wells, such as the behaviour resulting from insufficient gas as a result of a reduction in availability or in overconsumption, nor of the behaviour of the system for collecting the hydrocarbons produced, nor of the behaviour of the downstream treatment unit, these being common to all the wells.

Another procedure employed for operating a well producing in gas-injection-activated mode, known as the dynamic gas allocation procedure, makes it possible to limit the effect of the perturbations on the pressure in the injection gas system. This procedure consists in allocating a flow of activation gas to each well, calculated depending on the activation gas available in the system and on the gas sensitivity of each well.

This dynamic gas allocation procedure has two drawbacks:

- it does not take account of the operating status of the wells and therefore of the requirements specific to each status,
- it does not take account of the status which results from modifying the allocated gas flow, and therefore of the new actual requirement.

These drawbacks may make this procedure inoperative, especially during the well startup phases.

Thus, perturbations in the hydrocarbon collecting system, such as a circuit obstruction, a variation in the amount of injection gas available, an excessive rise of a liquid level in a separating tank or a rise in pressure in a circuit, result in plants being put into safety mode and consequently result in production being stopped.

An operating incident on one well may, via the plant in common, create perturbations on some or all of the other wells and result in total shutdown of the plants.

When such incidents occur, especially during the phases in which the plant is being put into safety mode or is being restarted, the equipment is subjected to very large mechanical, thermal and hydraulic stresses which may damage it and, in all cases, may reduce its lifetime.

DESCRIPTION OF THE INVENTION

The object of the present invention is specifically to remedy these drawbacks by proposing a method of operating a plant for the production of hydrocarbons in the form of oil and gas, comprising several wells, a system for collecting the hydrocarbons produced and a downstream unit for treating the hydrocarbons produced, which method takes account of the operating status of all the wells and of the variation in physical quantities representative of the operation of the various components of the plant.

The method of the invention also makes it possible to operate a hydrocarbon production plant which additionally includes a gas system for activating gas-injection-activated wells.

The method of the invention is applicable equally well to starting and shutting down the wells as to operating them after startup.

By virtue of the invention, production stoppages associated with perturbations in the activation gas system, in the system for collecting the hydrocarbons produced and in the downstream treatment unit may be avoided and production maintained at its optimum level in complete safety.

For this purpose, the invention proposes a method of operating a plant for the production of hydrocarbons in the form of oil and gas, comprising several wells, a system for collecting the hydrocarbons produced and a downstream unit for treating the hydrocarbons produced, the said system and the said downstream unit having sensors for measuring physical quantities representative of their operation, each well being controlled according to an individual procedure using modifiable control parameters and data representative of the operating status of the single controlled well, the method being characterized in that it consists in automatically modifying the control parameters used by the individual procedure for controlling each of the wells, depending on at least one of the physical quantities measured and on the data representative of the status of operation of all of the wells.

According to another characteristic of the invention, at least one of the wells being activated by gas injection, the plant additionally having a pressurized-gas system for activating the said well, fitted with a sensor for measuring a physical quantity representative of its operating status, it consists in comparing the value of the said physical quantity with a predetermined very high threshold and, if the said value is greater than the said threshold, in modifying at least one parameter of the individual procedure for controlling at least one gas-injection-activated well, in order to initiate at least one action to increase the consumption of activation gas so as to bring the pressure measured in the activation gas system back down to a value below that of the predetermined very high threshold.

According to another characteristic of the invention, the physical quantity measured is the pressure in the gas system for activating the gas-injection-activated wells.

According to another characteristic of the invention, the action to increase the consumption of activation gas consists in starting up at least one gas-injection-activated well that has been shut down.

According to another characteristic of the invention, the action to increase the consumption of activation gas consists in increasing the flow rate of gas injected into at least one gas-injection-activated well which is currently producing.

According to another characteristic of the invention, the actions to increase the consumption of gas for activating the gas-injection-activated wells are assigned a predetermined operating priority rank and the action initiated in order to increase the consumption of activation gas is the highest-priority action given the operating status of each of the wells.

According to another characteristic of the invention, at least one of the wells being activated by gas injection, the plant additionally having a pressurized-gas system for activating the said well, fitted with a sensor for measuring a physical quantity representative of its operation, it consists in comparing the value of the said physical quantity with a predetermined high threshold and, if the said value is below the said threshold, in modifying at least one parameter of the individual procedure for controlling at least one gas-injection-activated well in order to initiate at least one action to decrease the consumption of activation gas so as to bring the measured pressure in the activation gas system back up to a value above that of the predetermined very high threshold.

According to another characteristic of the invention, the physical quantity measured is the pressure in he gas system for activating the gas-injection-activated wells.

According to another characteristic of the invention, the action to decrease the consumption of activation gas consists in shutting down at least one gas-injection-activated well which is currently producing.

According to another characteristic of the invention, the action to decrease the consumption of activation gas consists in decreasing the flow rate of gas injected into at least one gas-injection-activated well which is currently producing.

According to another characteristic of the invention, the actions to decrease the consumption of gas for activating the gas-injection-activated wells are assigned a predetermined operating priority rank and the action initiated in order to decrease the consumption of activation gas is the highest-priority action given the operating status of each of the wells.

According to another characteristic, the invention consists in comparing the value of a measured physical quantity with a predetermined very high threshold and, if the value of the said physical quantity is above the said threshold, in modifying at least one parameter of the individual procedure for controlling at least one well, in order to initiate at least one action to decrease the production of hydrocarbons so as to bring the value of the measured physical quantity back down to a value below that of the very high predetermined threshold.

According to another characteristic of the invention, the action to decrease the production of hydrocarbons consists in shutting down one well which is currently producing.

According to another characteristic of the invention, the action to decrease the production of hydrocarbons consists in decreasing the production of a well which is currently producing.

According to another characteristic of the invention, the actions to decrease the production of hydrocarbons are assigned a predetermined operating priority rank and the action initiated in order to decrease the production of hydrocarbons is the highest-priority action given the operating status of each of the wells.

According to another characteristic, the invention consists in comparing the value of a measured physical quantity with a predetermined high threshold and, if the value of the said physical quantity is below the said threshold, in modifying at least one parameter of the individual procedure for controlling at least one well in order to initiate at least one action to increase the production of hydrocarbons so as to bring the value of the measured physical quantity back up to a value above that of the predetermined high threshold.

According to another characteristic of the invention, the action to increase the production of hydrocarbons consists in increasing the production of hydrocarbons from a well which is currently producing.

According to another characteristic of the invention, the action to increase the production of hydrocarbons consists in starting up a well that has been shut down.

According to another characteristic of the invention, the actions to increase the production of hydrocarbons are assigned a predetermined operating priority rank and the action initiated in order to increase the production of hydrocarbons is the highest-priority action given the operating status of each of the wells.

DETAILED DESCRIPTION OF THE INVENTION

In general, the method of the invention is used to operate a plant for the production of hydrocarbons in the form or oil and gas comprising several wells, a pressurized activation gas system, a system for collecting the hydrocarbons produced and a downstream unit for treating the hydrocarbons produced.

Figure 1:
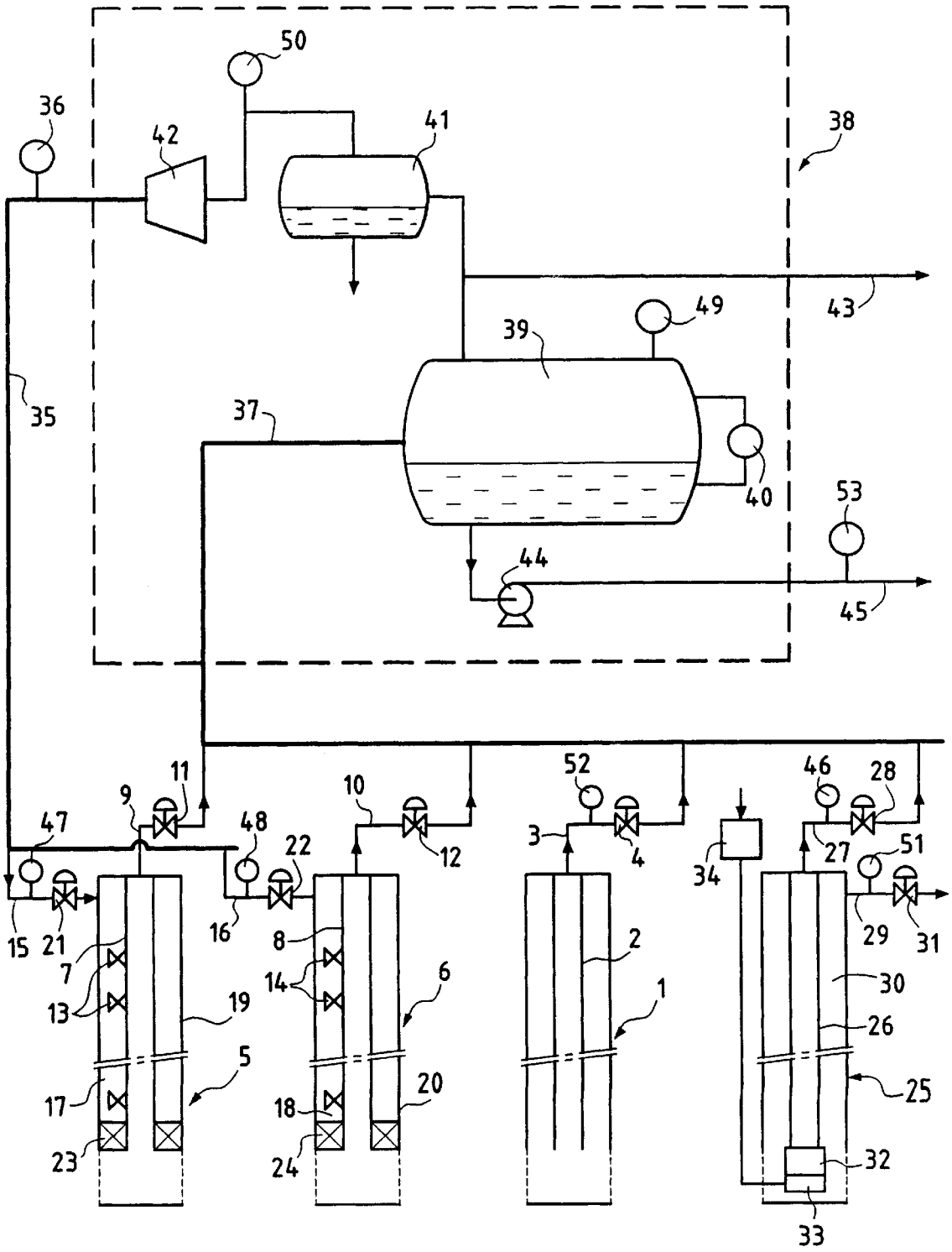

FIG. 1 shows the main components of a hydrocarbon production plant given by way of example, which comprises:

- a flowing well 1, i.e. a well for extraction from a reservoir in which the natural pressure of the hydrocarbons is sufficient for them to rise from the bottom of the well up to the wellhead via a production string 2 to which an oil output line 3 is connected, this line 3 being fitted with a choke 4 which allows the output of the hydrocarbons to be controlled, and with a sensor 52 for measuring the said flow rate;
- a well 5 producing in gas-injection-activated mode, which comprises a production string 7 extended at its top by a line 9 provided with an oil output choke 11, gas injection valves 13 placed at optimized intervals along the production string 7, a pipe 15 for injecting gas into the annular space 17 defined by the production string 7 and the casing 19 which forms the wall of the well, this pipe 15 being fitted with a choke 21 for controlling the flow rate of injected gas, an annular isolating seal 23 at its lower end, and a sensor 47 upstream of the choke 21 for controlling the flow rate of injected gas;
- a well 6 producing in gas-injection-activated mode, which comprises a production string 8 extended at its top by a line 10 provided with an oil output choke 12, gas injection valves 14 placed at optimized intervals along the production string 8, a pipe 16 for injecting gas into the annular space 18 defined by the production string 7 and the casing 20 which forms the wall of the well, this pipe being fitted with a choke 22 for controlling the flow rate of injected gas, an annular isolating seal 24 at its lower end and a sensor 48 for measuring the flow rate of injected gas, this sensor being placed upstream of the choke 22 for controlling the flow rate of injected gas;
- a well 25 producing in activated mode using a submerged pumping device, which comprises a production string 26 extended at its top by a line 27 provided with an oil output choke 28, a line 29 connected to the top of the annular space 30 and fitted with a gas ventilation choke 31, at the bottom, a submerged pump 32 driven by an electric motor 33 supplied by a variable-frequency supply 34, which allows the hydrocarbons at the bottom of the well to rise up towards the wellhead via the production string 26, a sensor 46 for measuring the pressure upstream of the oil output choke 28 and a sensor 51 for measuring the pressure upstream of the choke 31;
- a pressurized-gas system 35 which supplies the lines 15 and 16 connected to the annular spaces 17 and 18 of the gas-injection-activated wells 5 and 6, the pressure in this system being measured by the sensor 36;
- a system 37 for collecting the hydrocarbons produced, to which the hydrocarbon output lines 3, 9, 10 and 27 of each well are connected;
- a downstream unit 38 for treating the hydrocarbons produced, supplied via the hydrocarbon collecting system 37, which includes a tank 39 for separating the hydrocarbons produced into oil and gas, the oil level in which is measured by a sensor 40 and the pressure in which is measured by a sensor 49, the separated oil containing water which has risen from the bottom of the well at the same time as the hydrocarbons. The gas resulting from separating the hydrocarbons feeds, on the one hand, a tank 41 placed on the intake side of a compressor 42 which compresses the gas in order to inject it into the gas system 35 and, on the other hand, a line 43 for discharging the gas produced. The oil at the bottom of the separator tank 39 is drawn off by a pump which delivers it into a line 45 for discharging the oil produced.

The apparatus also includes, not shown in FIG. 1, means for putting the plant into safety mode.

Figure 2:
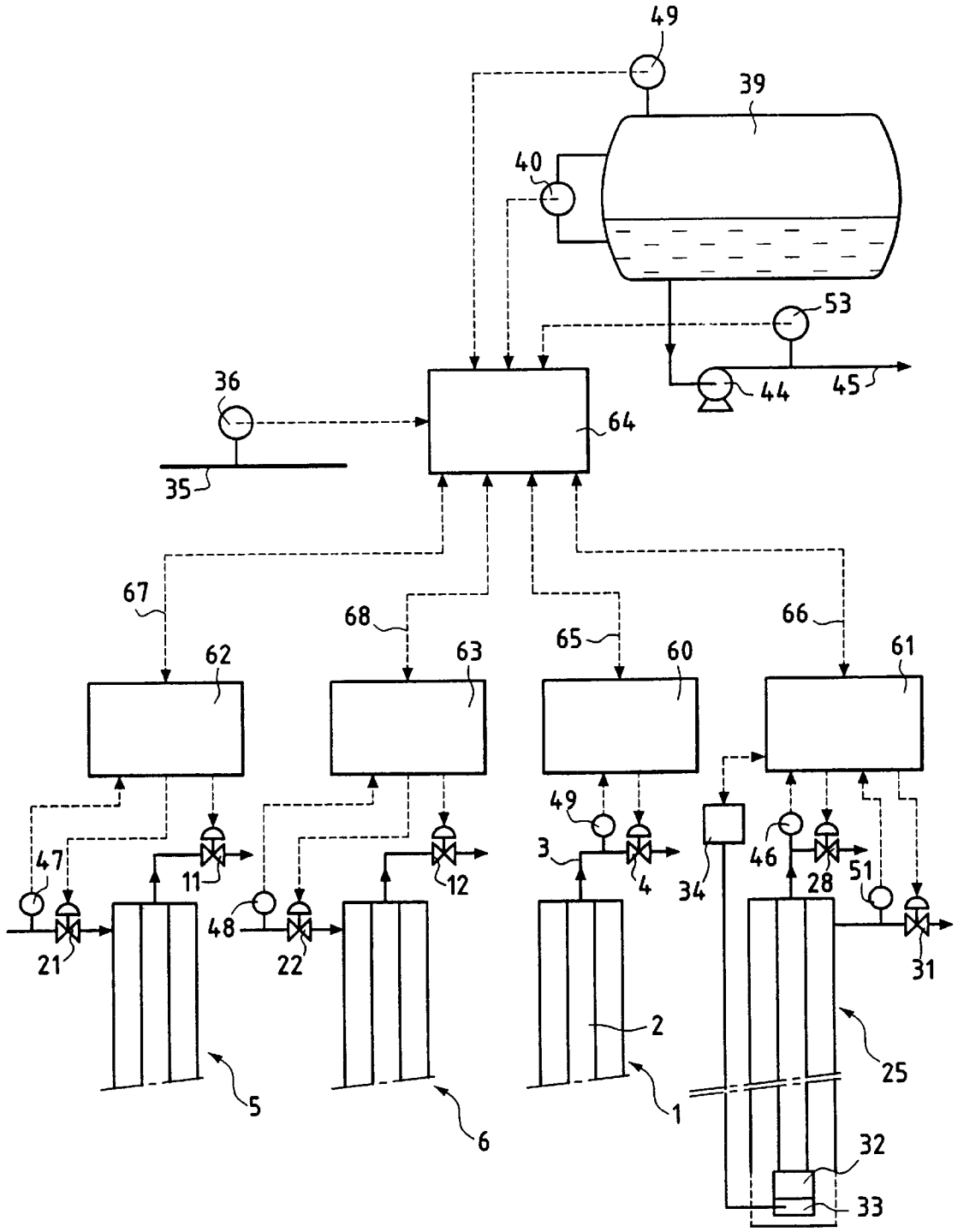

FIG. 2 shows an apparatus for implementing the method of the invention, which comprises:

- a controller 60, for controlling the well 1 producing in flowing mode, which receives the signal emitted by the sensor 52 and acts on the oil output choke 4. The procedure for individually controlling this well 1 includes a startup sequence which consists, from the shut-down/on-standby status in gradually opening the choke 4 in order to obtain a predetermined flow rate of oil produced, corresponding to the minimum production mode for this well. After a startup phase, in order to switch to production mode, the individual procedure for controlling this well 25 consists in slaving the flow rate of hydrocarbons produced, measured by means of the sensor 52, to a set value stored in the controller 60 in the form of a control parameter, by acting on the oil output choke 4;
- a controller 61, for controlling the well 25 activated by a submerged pumping device, which receives the signals delivered by the pressure sensors 46 and 51, which are upstream of the oil output choke 28 and of the gas ventilation choke 31, and a signal representative of the frequency of the electric current delivered by the variable-frequency supply 34 and acts on the oil output choke 28 and the gas ventilation choke 31 and on the frequency of the variable-frequency supply 34. The procedure for individually controlling this well 25 includes a startup sequence which consists, starting from a shut-down/on-standby status, in gradually increasing the speed of the motor 33 by acting on the frequency of the variable supply 34 and in acting on the chokes 28 and 31 in order to bring the well to a minimum production mode corresponding to a predetermined flow rate of oil produced, the value of which is stored in the controller 61 in the form of a modifiable control parameter. After a startup phase, the individual procedure for controlling this well 25, in order to establish a production mode, consists:
  - in increasing the speed of the motor 33 to a target value stored in the form of a control parameter in the controller 61,
  - in opening the oil output choke 28 to a value calculated depending on the target value of the speed of the motor 33 and
  - in acting on the gas ventilation choke 31 in order to maintain the pressure upstream of the said choke at a value calculated depending on the target value of the speed of the motor 33;
- a controller 62, for controlling the gas-injection-activated well 5, which receives signals delivered by the injected-gas flow rate sensor 47 and acts on the oil output choke 11 and the gas injection choke 21. The procedure for individually controlling this well 5 consists, starting from a shut-down/on-standby status, in acting on the oil output choke 11 and the gas injection choke 21 in a predetermined sequence in order to establish a minimum production mode. Starting from this minimum production mode, the procedure for individually controlling this well 5, in order to switch to a production mode, consists in slaving the position of the oil output choke 11 to a predetermined value and in acting on the gas injection choke 21 in order to slave the injection gas flow rate to a set value stored in the controller 62 in the form of a control parameter;

a controller 63, for controlling the gas-injection-activated well 6, which receives signals delivered by the oil output flow rate sensor 48 and acts on the oil output choke 12 and the gas injection choke 22;

the procedure for individually controlling this well 6 consists, starting from a shut-down/on-standby status, in acting on the oil output choke 12 and the gas injection choke 22 in a predetermined sequence in order to establish a minimum production mode. Starting from this minimum production rate, the procedure for individually controlling this well 6 consists in slaving the position of the oil output choke 12 to a predetermined value and in acting on the gas injection choke 22 in order to slave the injection gas flow rate to a set value stored in the controller 63 in the form of a control parameter;

a supervising controller 64, connected to the controllers 60, 61, 62 and 63 for controlling each of the wells 1, 5, 6 and 25, which receives the signals delivered by:

the pressure sensor 36 in the injection gas system 35, the sensor 40 for measuring the level in the tank 39 for separating the hydrocarbons into oil and gas, the sensor 49 for measuring the pressure in the tank 39 for separating the hydrocarbons into oil and gas and the pressure sensor 53 in the line 45 for discharging the oil produced.

Each controller 60, 61 and 62 is provided with a memory which contains:

a program corresponding to the procedure for individually controlling each well;

parameters for individually controlling each well, such as the set values of oil flow rates for any type of well, the set values of the injected-gas flow rates for the gas-injection-activated wells, the set values of the ventilation gas flow rate for the pumping-activated wells;

data representative of the operating status of each well that it controls, which are as follows:

decommissioned, shut-down/on-standby, in startup mode, in minimum production mode, in production mode;

parameters for individually controlling each well, the values of which are interpreted by the individual control procedure, such as change-of-status commands.

The supervising controller 64 is provided with a memory which contains a program for implementing the method of operating the plant for the production of hydrocarbons.

The controllers 60, 61, 62 and 63 for individually controlling each well and the supervising controller 64 are provided with two-way communication means (not shown) which allow the controller 64, via the electrical links 65, 66, 67 and 68:

to know the operating status of each well;

to know the values of the control parameters used by the procedures for controlling each well;

to modify the values of the control parameters.

The controllers 61 to 64 are also connected to the system for putting the plant in safety mode, which informs them that the components of the plant have therefore been put into safety mode and therefore that these components, especially the wells, are decommissioned.

According to a first way of implementing the method of the invention, the supervising controller 64 compares the pressure in the injection gas system 35, measured by the sensor 36, with a predetermined high threshold.

If this pressure is below the value of this threshold, the controller 64 does not act.

If this pressure exceeds the value of this threshold, the supervising controller 64 issues commands, in the form of modifications to the control parameters, to the controllers 62 and 63 for controlling the gas-injection-activated wells 5 and 6, in order to increase the flow rate of injected gas and, consequently, to lower the pressure in the gas injection system 35.

To do this, the supervising controller 64 reads, in the memory of the controller 62, by virtue of the two-way communication means, the operating status of the well 5. If this status indicates that the well 5 is in production mode, i.e. it is producing hydrocarbons at a flow rate controlled by the procedure for individually controlling the well 5. In order to increase the flow rate of injected gas, the supervising controller 64 increases the set value of the gas flow rate stored in the controller 62 in the form of a control parameter.

The supervising controller 64 repeats this operation until the pressure in the activation gas system 35 again goes below the value of the high threshold. If, after an experimentally predetermined time, the pressure is still above the high threshold, the supervising controller 64 executes a series of similar operations in order to increase the production of the gas-injection-activated well 6.

If one or other of the gas-injection-activated wells 5 and 6 is not in production mode, that is to say it is in the shut-down/on-standby status, in order to increase the flow rate of injected gas, the supervising controller 64 checks that this well is decommissioned and gives a startup command, by modifying the corresponding status parameter in the controller that controls this well.

In order to increase the flow rates of hydrocarbons produced by each of the wells, the actions on the oil output choke and the gas ventilation choke, initiated either by increasing the set values or by starting up a shut-down well, are carried out by each controller 62 and 63 according to the procedure for individually controlling each well 5 and 6.

Thus, an excessive increase in the pressure in the system, which could trigger the plant being put into partial safety mode, and which could result in a loss of production, is avoided. Simultaneously, the production of hydrocarbons by the gas-injection-activated wells is maximized.

According to a second way of implementing the invention, priority ranks are assigned, on the one hand, to the actions to increase production, i.e. to the actions to start up and run the wells in production mode, and, on the other hand, to the actions to decrease the production, i.e. to the actions to put them in minimum production mode and to shut them down. These priority rank assignments are stored in the supervising controller 64 in the form of tables, such as the tables T1 and T2 below:

TABLE T1

| Well | | | Priority rank of the actions to increase production | |
|---|---|---|---|---|
| No. | Type | Reference FIGS. 1 and 2 | Startup | Putting into production mode |
| 1 | F | 1 | 1 | 2 |
| 2 | GA | 5 | 4 | 6 |
| 3 | GA | 6 | 5 | 7 |
| 4 | PA | 25 | 3 | 0 |

TABLE T2

| Well | | | Priority rank of the actions for increasing production | |
|---|---|---|---|---|
| No. | Type | Reference FIGS. 1 and 2 | Putting into minimum production mode | Shutdown |
| 1 | F | 1 | 3 | 5 |
| 2 | GA | 5 | 2 | 4 |
| 3 | GA | 6 | 1 | 3 |
| 4 | PA | 25 | 0 | 6 |

In Tables T1 and T2, the highest-priority operation is that whose rank is lowest; thus, the operation of rank i is of higher priority than the operation of rank i+j, where j>1, and the rank of priority 0 means that the corresponding status does not exist for the type of well to which it is assigned.

In the well-type column, F means that the well is of the flowing type, GA means that it is of the gas-injection-activated type and PA means that it is activated by pumping.

The supervising controller 64 also contains, in its memory, tables of the possible transitions between the various initial and final statuses of the wells, these tables having the following structure:

TABLE T3

| | Possible transitions in the case of actions to increase oil production | | | | |
|---|---|---|---|---|---|
| | Final Status | | | | |
| Initial status ↓ | Decommissioned | Shut-down/on-standby | In startup mode | Minimum production mode | Production mode |
| Decommissioned | | | | | |
| Shut-down/on-standby | | | yes | | |
| In startup mode | | | | | |

TABLE T3-continued

| | Possible transitions in the case of actions to increase oil production | | | | |
|---|---|---|---|---|---|
| | Final Status | | | | |
| Initial status ↓ | Decommissioned | Shut-down/on-standby | In startup mode | Minimum production mode | Production mode |
| Minimum production mode | | | | | yes |
| Production mode | | | | | |

TABLE T4

| | Possible transitions in the case of actions to decrease oil production | | | | |
|---|---|---|---|---|---|
| | Final Status | | | | |
| Initial status ↓ | Decommissioned | Shut-down/on-standby | In startup mode | Minimum production mode | Production mode |
| Decommissioned | | | | | |
| Shut-down/on-standby | | | | | |
| In startup mode | | yes | | | |
| Minimum production mode | | yes | yes | | |
| Production mode | | | | yes | |

The plant having been started up according to a known startup procedure, the status of the wells is as follows:

TABLE T5

| Well No. | Status of the wells (stored in the controllers for individually controlling each well) |
|---|---|
| 1 | Minimum production mode |
| 2 | Shut-down/on-standby |
| 3 | Shut-down/on-standby |
| 4 | Decommissioned |

According to the second way of implementing the invention, the supervising controller 64 permanently compares the value of the pressure in the line 45, measured by the sensor 53, to a high threshold P1 and to a very high threshold P2, P1 and P2 being predetermined depending on the characteristics of the plant.

When value of the pressure in the line 45 is between P1 and P2, the controller 64 takes no action.

When the value of the pressure in the line 45 is below the threshold P1, the supervising controller 64 Looks in Table T1 for the highest-priority action to increase hydrocarbon production. In our example, given that the action of rank 1 has already been carried out, the highest-priority action is that of rank 2, which corresponds to putting Well No. 1 into production mode. According to Table 4, the only possible way of achieving this status is from the minimum production mode status. Using the means of communication with the controller 60, the supervising controller 64 checks that the status of Well No. 1 is in minimum production mode and if this is so, as in our example (Table T5), gives the controller 60, via the communication means, the command to switch the well 1 to the "production mode" status and the oil flow rate set value to be respected.

This command is interpreted by the procedure for individually controlling the well 1, which gives the value transmitted by the controller 64 to the oil flow rate set value and updates the data representative of the status of the well 1.

The status of the wells is as follows:

TABLE T5a

| Well No. | Status of the wells |
|---|---|
| 1 | Production mode |
| 2 | Shut-down/on-standby |
| 3 | Shut-down/on-standby |
| 4 | Decommissioned |

After an experimentally defined time delay has elapsed, in order to allow time for the requested action to be carried out, the supervising controller 64 again compares the value of the pressure in the line 45 to the thresholds P1 and P2. If the value of the pressure in the line 45 is below the threshold P1, the supervising controller 64 looks in Table T1 for the highest-priority action to increase hydrocarbon production. In our example, given that the actions of ranks 1 and 2 have already been carried out, the highest-priority action is that of rank 3, which corresponds to starting up Well No. 4, the operating status of which is "decommissioned".

Well No. 4 cannot therefore be started up and the action of rank 3 cannot be carried out.

The supervising controller 64 looks in Table T1 for the highest-priority action to increase hydrocarbon production, which is that of rank 4, corresponding to starting up Well No. 2. Since this well is of the gas-injection-activated type, the controller 64 additionally checks the availability of gas in the injection gas system 35, by checking that the pressure measured by the sensor 36 is above the nominal value for operating this system 35, this value being established depending on the characteristics of the components of the invention.

This being so in our example, the supervising controller 64 gives the controller 62 the command to switch the well to startup mode.

This command is interpreted by the procedure for individually controlling the well 2, which initiates the startup sequence for this well.

The operating status of the wells is as follows:

TABLE T5b

| Well No. | Status of the wells |
|---|---|
| 1 | Production mode |
| 2 | Startup mode |
| 3 | Shut-down/on-standby |
| 4 | Decommissioned |

If the gas availability condition had not been satisfied, the controller 64 would have looked for the highest possible priority action to increase production, given the operating status of the wells.

We will now consider that the well 4 has been put into commission and that it is in the "shut-down/on-standby" status.

The operating status of the wells is as follows:

TABLE T5c

| Well No. | Status of the wells |
|---|---|
| 1 | Production mode |
| 2 | Startup mode |
| 3 | Shut-down/on-standby |
| 4 | Shut-down/on-standby |

The supervising controller 64 compares the value of the pressure in the line 45 to the thresholds P1 and P2 . If the value of the pressure in the line 45 is below the threshold P1, the supervising controller 64 looks in Table T1 for the highest-priority action to increase hydrocarbon production, which is that of rank 3 corresponding to switching Well No. 4 into startup mode. The supervising controller 64 gives the local controller 61 for individually controlling the well 4, via the communication means, the command to switch the well 4 to startup status. This command is interpreted by the procedure for individually controlling the well 4, which initiates the startup sequence.

The operating status of the wells is then as follows:

TABLE T5d

| Well No. | Status of the wells |
|---|---|
| 1 | Production mode |
| 2 | Startup mode |
| 3 | Shut-down/on-standby |
| 4 | Startup mode |

If the value of the pressure in the line 45 becomes greater than the threshold P2, the supervising controller 64 looks in Table T2 for the highest-priority action to decrease hydrocarbon production. In our example, the highest-priority action is that of rank: 1, which corresponds to partially cutting off Well No. 3; since this well is in the shut-down/on-standby status, this action cannot be carried out. The supervising controller 64 looks for the next highest priority action, which is that of rank 2, corresponding to partially cutting off Well No. 2. Since Well No. 2 is in startup mode, this action cannot be carried out. The supervising controller 64 looks for the next highest priority action, which is that of rank 3, corresponding to partially cutting off Well No. 1. The supervising controller 64 gives the controller 60 for individually controlling the well 1, via the communication means, the command to switch the well 1 to the status corresponding to the minimum production mode. This command is interpreted by the procedure for individually controlling the well 1, which acts accordingly.

The operating status of the wells is then as follows:

TABLE T5e

| Well No. | Status of the wells |
|---|---|
| 1 | Minimum production mode |
| 2 | Startup mode |
| 3 | Shut-down/on-standby |
| 4 | Startup mode |

According to the same procedure as that just described, the supervising controller 64 simultaneously compares the pressure in the separator tank 39, measured by means of the sensor 49, with two thresholds, respectively the high threshold P3 and the very high threshold P4. If this pressure exceeds the threshold P4, it initiates actions to decrease the oil production depending on the priorities assigned to these actions, taking into account the operating status of the wells. If this pressure is below the threshold P3, the controller 64 initiates actions to increase oil production, depending on the priorities assigned to these actions taking into account the operating status of the wells.

According to the procedure described above, the supervising controller 64 simultaneously compares the liquid level in the separator tank 39, measured by means of the sensor 40, with two thresholds, the high threshold P5 and the very high threshold P6, respectively. If this pressure exceeds the threshold P6, it initiates actions to decrease oil production depending on the priorities assigned to these actions, taking into account the operating status of the wells. If this pressure is below the threshold P5, the controller 64 initiates actions to increase oil production depending on the priorities assigned to these actions, taking into account the operating status of the wells.

Thus, by virtue of the invention, any operating anomaly, such as an obstruction downstream of the line 45 or upstream overproduction of oil, which is manifested by an increase in the pressure in the line 45, automatically results in a series of actions to decrease the production, these having the effect of rapidly bringing the pressure in the line 45 down below the value of the threshold P2 and thus of preventing it from reaching a safety-mode-triggering threshold which generally results in the plant being shut down. The actions to decrease production, being classified by priority and executed taking into account the operating status of the wells, are managed in an optimum manner.

In addition, by virtue of the invention, oil production is maintained at its maximum value, corresponding to the value of the pressure in the pipe 45 being between the thresholds P1 and P2, while respecting the operating constraints of the separator tank in complete safety.

The invention is not limited to operating a plant such as the one described above, which comprises four wells, an injection gas system, a system for collecting the hydrocarbons produced and a downstream treatment plant. It also applies to operating a plant comprising several dozen wells, several injection systems, several systems for collecting hydrocarbons and several downstream treatment units.

What is claimed is:

1. Method of operating a plant for the production of hydrocarbons in the form of oil and gas, comprising several wells, a system for collecting the hydrocarbons produced and a downstream unit for treating the hydrocarbons produced, the said system and the said downstream unit having sensors for measuring physical quantities representative of their operation, each well being controlled according to an individual procedure using modifiable control parameters and data representative of the operating status of the single controlled well, wherein the method comprises automatically modifying the control parameters used by the individual procedure for controlling each of the wells, depending on at least one of the physical quantities measured and on the data representative of the status of operation of all of the wells.

2. Method according to claim 1, wherein, at least one of the wells being activated by gas injection, the plant additionally having a pressurized-gas system for activating the said well, fitted with a sensor for measuring a physical quantity representative of its operating status, it consists in comparing the value of the said physical quantity with a predetermined very high threshold and, if the said value is greater than the said threshold, in modifying at least one parameter of the individual procedure for controlling at least one gas-injection-activated well, in order to initiate at least one action to increase the consumption of activation gas so as to bring the pressure measured in the activation gas system back down to a value below that of the predetermined very high threshold.

3. Method according to claim 2, wherein the physical quantity measured is the pressure in the gas system for activating the gas-injection-activated wells.

4. Method according to claim 2, characterized in that the action to increase the consumption of activation gas consists in starting at least one gas-injection-activated well that has been shut down.

5. Method according to claim 2, characterized in that the action to increase the consumption of activation gas consists in increasing the flow rate of gas injected into at least one gas-injection-activated well which is currently producing.

6. Method according to claim 2, wherein the actions to increase the consumption of gas for activating the gas-injection activated wells are assigned a predetermined operating priority rank and the action initiated in order to increase the consumption of activation gas is the highest-priority action given the operating status of each of the wells.

7. Method according to claim 1, wherein, at least one of the wells being activated by gas injection, the plant additionally having a pressurized-gas system for activating the said well, fitted with a sensor for measuring a physical quantity representative of its operation, it consists in comparing the value of the said physical quantity with a predetermined high threshold and, if the said value is below the said threshold, in modifying at least one parameter of the individual procedure for controlling at least one gas-injection-activated well in order to initiate at least one action to decrease the consumption of activation gas so as to bring the measured pressure in the activation gas system back up to a value above that of the predetermined high threshold.

8. Method according to claim 7, wherein the measured physical quantity is the pressure in the gas system for activating the gas-injection-activated wells.

9. Method according to claim 7 wherein the action to decrease the consumption of activation gas consists in shutting down at least one gas-injection-activated well which is currently producing.

10. Method according to claim 7 wherein the action to decrease the consumption of activation gas consists in decreasing the flow rate of gas injected into at least one gas-injection-activated well which is currently producing.

11. Method according to claim 7, wherein the actions to decrease the consumption of gas for activating the gas-injection activated wells are assigned a predetermined operating priority rank and the action initiated in order to decrease the consumption of activation gas is the highest-priority action given the operating status of each of the wells.

12. Method according to claim 1, wherein it consists in comparing the value of a measured physical quantity with a predetermined very high threshold and, if the value of the said physical quantity is above the said threshold, in modifying at least one parameter of the individual procedure for controlling at least one well, in order to initiate at least one action to decrease the production of hydrocarbons so as to bring the value of the measured physical quantity back down to a value below that of the very high predetermined threshold.

13. Method according to claim 12, wherein the action to decrease the production of hydrocarbons consists in shutting down at least one well which is currently producing.

14. Method according to claim 12, wherein the action to decrease the production of hydrocarbons consists in decreasing the production of a well which is currently producing.

15. Method according to claim 12, wherein the actions to decrease the production of hydrocarbons are assigned a predetermined operating priority rank and the action initiated in order to decrease the production of hydrocarbons is the highest-priority action given the operating status of each of the wells.

16. Method according to claim 1, wherein it consists in comparing the value of a measured physical quantity with a predetermined high threshold and, if the value of the said physical quantity is below the said threshold, in modifying at least one parameter of the individual procedure for controlling at least one well in order to initiate at least one action to increase the production of hydrocarbons so as to bring the value of the measured physical quantity back up to a value above that of the predetermined high threshold.

17. Method according to claim 16, wherein the action to increase the production of hydrocarbons consists in increasing the production of hydrocarbons from a well which is currently producing.

18. Method according to claim 16, wherein the action to increase the production of hydrocarbons consists in starting up a well that has been shut down.

19. Method according to claim 16, wherein the actions to increase the production of hydrocarbons are assigned a predetermined operating priority rank and the action initiated in order to increase the production of hydrocarbons is the highest-priority action given the operating status of each of the wells.

* * * * *